US010693249B2

(12) United States Patent
Toh et al.

(10) Patent No.: US 10,693,249 B2
(45) Date of Patent: Jun. 23, 2020

(54) ELECTRICAL CONNECTOR HAVING WAFER GROUPS ASSEMBLED TO SLOTS

(71) Applicant: Molex, LLC, Lisle, IL (US)

(72) Inventors: Ser Kiat Toh, Singapore (SG); Paul L. Rishworth, Naperville, IL (US); Chien Ching Teh, Singapore (SG)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 15/912,898

(22) Filed: Mar. 6, 2018

(65) Prior Publication Data

US 2018/0261942 A1 Sep. 13, 2018

(30) Foreign Application Priority Data

Mar. 7, 2017 (CN) ..... 2017 1 0130964

(51) Int. Cl.
*H01R 12/73* (2011.01)
*H01R 12/70* (2011.01)
*H01R 13/6587* (2011.01)

(52) U.S. Cl.
CPC ..... *H01R 12/737* (2013.01); *H01R 12/7047* (2013.01); *H01R 12/732* (2013.01); *H01R 13/6587* (2013.01)

(58) Field of Classification Search
CPC ..... H01R 12/7076; H01R 12/737; H01R 12/7047; H01R 12/732; H01R 13/6587
See application file for complete search history.

(56) References Cited

U.S. PATENT DOCUMENTS

| | | | | |
|---|---|---|---|---|
| 5,511,985 | A | 4/1996 | Noschese et al. | |
| 6,814,619 | B1 | 11/2004 | Stokoe et al. | |
| 7,993,147 | B2 * | 8/2011 | Cole | H01R 13/514 439/607.39 |
| 9,246,251 | B2 * | 1/2016 | Regnier | H01R 9/2408 |
| 9,257,778 | B2 | 2/2016 | Buck et al. | |
| 9,537,239 | B1 * | 1/2017 | Liu | H01R 12/7076 |
| 10,020,603 | B1 * | 7/2018 | Liu | H01R 12/7088 |
| 2010/0210123 | A1 * | 8/2010 | Cole | H01R 13/514 439/79 |
| 2013/0288532 | A1 * | 10/2013 | Lai | G06F 1/185 439/629 |

(Continued)

FOREIGN PATENT DOCUMENTS

| | | | |
|---|---|---|---|
| CN | 101164204 | A | 4/2008 |
| CN | 201820905 | U | 5/2011 |

(Continued)

*Primary Examiner* — Abdullah A Riyami
*Assistant Examiner* — Nader J Alhawamdeh
(74) *Attorney, Agent, or Firm* — Molex, LLC

(57) ABSTRACT

The present disclosure discloses an electrical connector which comprises a shell, a first wafer group and a second wafer group. The shell comprises: a first frame portion defining a first slot; a second frame portion defining a second slot; a first supporting portion positioned at a first side of the shell; a second supporting portion positioned at a second side of the shell, and a bridging portion connecting the first frame portion and the second frame portion. The bridging portion, the first frame portion and the second frame portion cooperatively define an air flow channel. The first wafer group is assembled to the first slot. The second wafer group is assembled to the second slot.

13 Claims, 17 Drawing Sheets

(56) References Cited

U.S. PATENT DOCUMENTS

| | | | | |
|---|---|---|---|---|
| 2016/0315419 | A1 | 10/2016 | Regnier et al. | |
| 2016/0365654 | A1* | 12/2016 | Wormsbecher .... | H01R 12/7076 |
| 2017/0006733 | A1* | 1/2017 | Gregori ..... | H05K 7/20127 |
| 2018/0261942 | A1* | 9/2018 | Toh ..... | H01R 13/6587 |

FOREIGN PATENT DOCUMENTS

| | | | |
|---|---|---|---|
| CN | 203481527 | U | 3/2014 |
| CN | 103807628 | A | 5/2014 |
| CN | 103988371 | A | 8/2014 |
| CN | 105071072 | A | 11/2015 |
| CN | 105379023 | A | 3/2016 |
| TW | 1229963 | B | 3/2005 |

* cited by examiner

ELECTRICAL CONNECTOR HAVING WAFER GROUPS ASSEMBLED TO SLOTS

RELATED APPLICATIONS

This application claims priority to Chinese Application No. 201710130964.1, filed Mar. 7, 2017, which is incorporated herein by reference in its entirety.

TECHNICAL FIELD

The present disclosure relates to an electrical connector, particularly relates to an electrical connector comprising a shell having a bridging portion.

BACKGROUND ART

FIG. 1 is a structural schematic view of an electrical connector assembly 10 in prior art, which is disclosed in United States patent application publication No. US2016/0365654A1. Referring to FIG. 1, an electrical connector assembly 10 comprises a plurality of electrical connectors 12 and a circuit board 14. The electrical connectors 12 are provided on the circuit board 14. The electrical connector 12 has a height H1 and a width W1, and a value of the height H1 is far larger than a value of the width W1, which makes the centre of gravity of the electrical connector 12 relatively higher. Moreover, a contact area between the electrical connector 12 and the circuit board 14 is in proportion to the width W1. Because the width W1 is relatively smaller, the contact area is relatively small. Because the centre of gravity of the electrical connector 12 is relatively higher and because the contact area between the electrical connector 12 and the circuit board 14 is relatively smaller, before the electrical connector 12 is fixed to the circuit board 14 by a fixing operation (for example, soldering operation), the electrical connector 12 easily shakes and can not be relatively stably placed on the circuit board 14.

FIG. 2 is a structural schematic view of an electrical connector assembly 20 in prior art, which is disclosed in U.S. Pat. No. 9,537,239B1. Referring to FIG. 2, the electrical connector assembly 20 comprises a plurality of card edge connectors 200, a plurality of clamping plates 220 and a lead guide plate 240. The card edge connectors 200 make fixing portions 202 thereof respectively inserted into a plurality of recessed grooves 222 of the clamping plates 220, by which the card edge connectors 200 are connected together. However, when the recessed groove 222 is manufactured, tolerance will be generated unavoidably, which makes a practical size of the recessed groove 222 may be larger than or less than a preset size. So, the fixing portion 202 of the card edge connector 200 may not be firmly inserted into the recessed groove 222 of the clamping plate 220. Therefore, reliability is relative lower. In addition to that the fixing portions 202 of the card edge connector 200 need to be aligned with the recessed grooves 222 of the clamping plates 220, the terminals 204 of the card edge connector 200 also need to be aligned with on apertures of the lead guide plate 240. However, because the tolerances of the recessed grooves 222 of the clamping plates 220 result in that a pitch between every two adjacent card edge connectors 200 is not consistent, a pitch between inserting ends of the terminals 204 is not consistent either, which results in that the inserting ends of the terminals 204 can not be aligned with the apertures. So, assembling is not relatively easy.

FIG. 3 is a structural schematic view of an electrical connector assembly 30 in prior art, which is disclosed in U.S. Pat. No. 7,993,147B2. Referring to FIG. 3, the electrical connector assembly 30 comprises a shroud 300 and a contact module 310. The shroud 300 comprises card edge slots 302, 304. However, there is a solid face 306 between the two card edge slots 302, 304, therefore heat dissipation is relatively worse.

SUMMARY

In order to resolve the above problems, an object of the present disclosure is to provide an electrical connector which comprises a shell, a first wafer group and a second wafer group. The shell comprises: a first frame portion defining a first slot; a second frame portion defining a second slot; a bridging portion connecting the first frame portion and the second frame portion, the bridging portion, the first frame portion and the second frame portion cooperatively define an air flow channel; a first supporting portion positioned at a first side of the shell; and a second supporting portion positioned at a second side of the shell. The first wafer group is assembled to the first slot. The second wafer group is assembled to the second slot.

In an embodiment of the present disclosure, the shell has a mounting end and a mating end, the mounting end and the mating end are opposite to each other, each of the first slot and the second slot extends to the mounting end and the mating end of the shell.

In an embodiment of the present disclosure, each of the first wafer group and the second wafer group comprises a first wafer and a second wafer, each of the first wafer and the second wafer comprises a wafer housing, the wafer housing has a mounting face and a mating face, the mounting face is perpendicular to the mating face.

In an embodiment of the present disclosure, the first wafer group and the second wafer group are respectively assembled to the first slot and the second slot by the mating faces of the wafer housings from the mounting end of the shell.

In an embodiment of the present disclosure, each of the first wafer and the second wafer further comprises terminals, each of the terminals has a mounting portion and a mating portion, the mounting portion of each of the terminals is positioned at the mounting face of the wafer housing, and the mating portion of each of the terminals is positioned at the mating face of the wafer housing and electrically connected to a card edge module.

In an embodiment of the present disclosure, the mating portions of the terminals of the first wafer and the mating portions of the terminals of the second wafer in the first wafer group are respectively positioned at two sides of the first slot.

In an embodiment of the present disclosure, the first supporting portion is close to the mating end of the shell relative to the second supporting portion, and the second supporting portion is close to the mounting end of the shell relative to the first supporting portion.

In an embodiment of the present disclosure, a bottom surface of the first supporting portion and a bottom surface of the second supporting portion are flush with a bottom surface of the first frame portion and a bottom surface of the second frame portion.

In an embodiment of the present disclosure, a bottom surface of the bridging portion is flush with a bottom surface of the first frame portion and a bottom surface of the second frame portion.

In an embodiment of the present disclosure, the bridging portion, the first frame portion and the second frame portion define another air flow channel below a bottom surface of the bridging portion.

In an embodiment of the present disclosure, the bridging portion has an arch guide surface along a card insertion direction in which a card edge module is inserted into the first slot.

In an embodiment of the present disclosure, when the electrical connector is electrically connected to a card edge module and a circuit board, an extending direction of a card edge of the card edge module and an extending direction of a board edge of the circuit board are orthogonal to each other.

In an embodiment of the present disclosure, each of the first supporting portion and the second supporting portion has a screw hole extending upwardly from a bottom surface of each of the first supporting portion and the second supporting portion, a circuit board independent of the electrical connector has a through hole corresponding to the screw hole.

In an embodiment of the present disclosure, each of the first frame portion and the second frame portion further comprises an extension portion, the extension portion is immediately adjacent to the mating end of the shell, and is formed by extending downwardly from a bottom surface of each of the first frame portion and the second frame portion, a bottom surface of the extension portion is lower than a bottom surface of the first supporting portion and a bottom surface of the second supporting portion.

In an embodiment of the present disclosure, a contact area between the electrical connector and the circuit board is in proportion to a width of the shell of the electrical connector. Because the shell of the electrical connector of the present disclosure has a bridging portion, the width of the shell of the electrical connector is relatively large. Therefore, before the electrical connector of the present disclosure is fixed to the circuit board by a fixing operation (for example, soldering operation), the electrical connector of the present disclosure does not relatively easily shake and can be relatively stably placed on the circuit board.

Reversely, in some electrical connectors in prior art, a contact area between an electrical connector and a circuit board is essentially equivalent to a width of a frame portion. Because the width of the frame portion of the electrical connector in prior art is relatively small, before the electrical connector in prior art is fixed to the circuit board by a fixing operation (for example, soldering operation), the electrical connector in prior art easily shakes and can not be relatively stably placed on the circuit board.

Moreover, because the first supporting portion is close to the mating end of the shell relative to the second supporting portion and the second supporting portion is close to the mounting end of the shell relative to the first supporting portion in the shell of the present disclosure, the second supporting portion of the first electrical connector and the first supporting portion of the second electrical connector can be arranged front-back along a card insertion direction of the first card edge module, which allows a distance between the second frame portion of the first electrical connector and the first frame portion of the second electrical connector is relatively small. Therefore, the electrical connector assembly occupies a relatively small area in a plane perpendicular to the card insertion direction of the first card edge module.

Moreover, the bridging portion, the first frame portion and the second frame portion of the shell of the present disclosure cooperatively define an air flow channel above the bridging portion. Therefore, air can flow between the first frame portion and the second frame portion, heat dissipation effect of the electrical connector of the present disclosure is relatively better.

In contrast, in some electrical connectors in prior art, there is not any air flow channel between a first frame portion defining a first slot for receiving a first card edge module (similar to the first frame portion of the present disclosure) and a second frame portion defining a second slot for receiving a second card edge module (similar to the second frame portion of the present disclosure). For example, the electrical connector in prior art has a connecting solid face for connecting the first frame portion and the second frame portion. Because the connecting solid face, for example, is orthogonal to air flow direction in structure, flowing of air will be blocked. Therefore, heat dissipation effect of the electrical connector in prior art is worse.

Moreover, because the shell of the present disclosure may comprise two frame portions or three frame portions, the shell of the present disclosure can be applicable to an electrical connector having various number of card edge modules. For example, if the electrical connector needs to connect five card edge modules, it only needs to combine one shell which has two frame portions and one bridging portion and one shell which has three frame portions and two bridging portions. Therefore, the design of the shell of the present disclosure can allow the electrical connector to be applied more widely.

The foregoing has summarized rather broadly the features and the advantages of the present disclosure, so that the detailed description of the present disclosure that follows may be better understood. Other technical features and advantages which constitute the subject of the claims of the present disclosure will be described below. Those skilled in the art should understand that the conception and the specific embodiments disclosed below may be fairly readily utilized as modification or design of other structure or manufacturing method to achieve the same object of the present disclosure. Those skilled in the art should further understand that such equivalent variation cannot be departed from the spirit and scope of the present disclosure defined in the appended claims.

BRIEF DESCRIPTION OF THE DRAWINGS

Aspects of the present disclosure are best understood from the following detailed description and accompanying figures. Note that according to industry standard implementations, various features are not drawn to scale. In fact, for clarity of discussion, the size of various features can be arbitrarily increased or decreased.

DETAILED DESCRIPTION OF THE PREFERRED EMBODIMENTS

The following content provides many different embodiments or examples for implementing different features of the present disclosure. The specific embodiments of the elements and configurations are described below to simplify the content of the present disclosure. Of course, these are only embodiments and are not used to limit the present disclosure. For example, the following description of forming a first feature on or above a second feature may include embodiments that form the first and second features that are in direct contact, as well as embodiments that form other features between the first and second features, so the first and second features are not in direct contact. In addition, the present disclosure may repeat element symbols and/or letters in different embodiments. This repetition is for the purpose of simplification and clarity and does not govern the relationship between different embodiments and/or architectures in question.

Furthermore, the present disclosure may use spatially corresponding terms, such as a simple description of such terms as "below", "lower than", "lower", "higher than", "higher" and the like to describe the relationship between one element or feature and another element or feature. Spatially corresponding terms are intended to encompass different orientations of the device in use or operation in addition to those described in the figures. The device may be positioned (rotated by 90 degrees or at other orientations) and the corresponding description of the space used in the present disclosure may be interpreted accordingly. It is to be understood that when a feature is formed above another feature or substrate, other features may be present therebetween.

Figure 1:
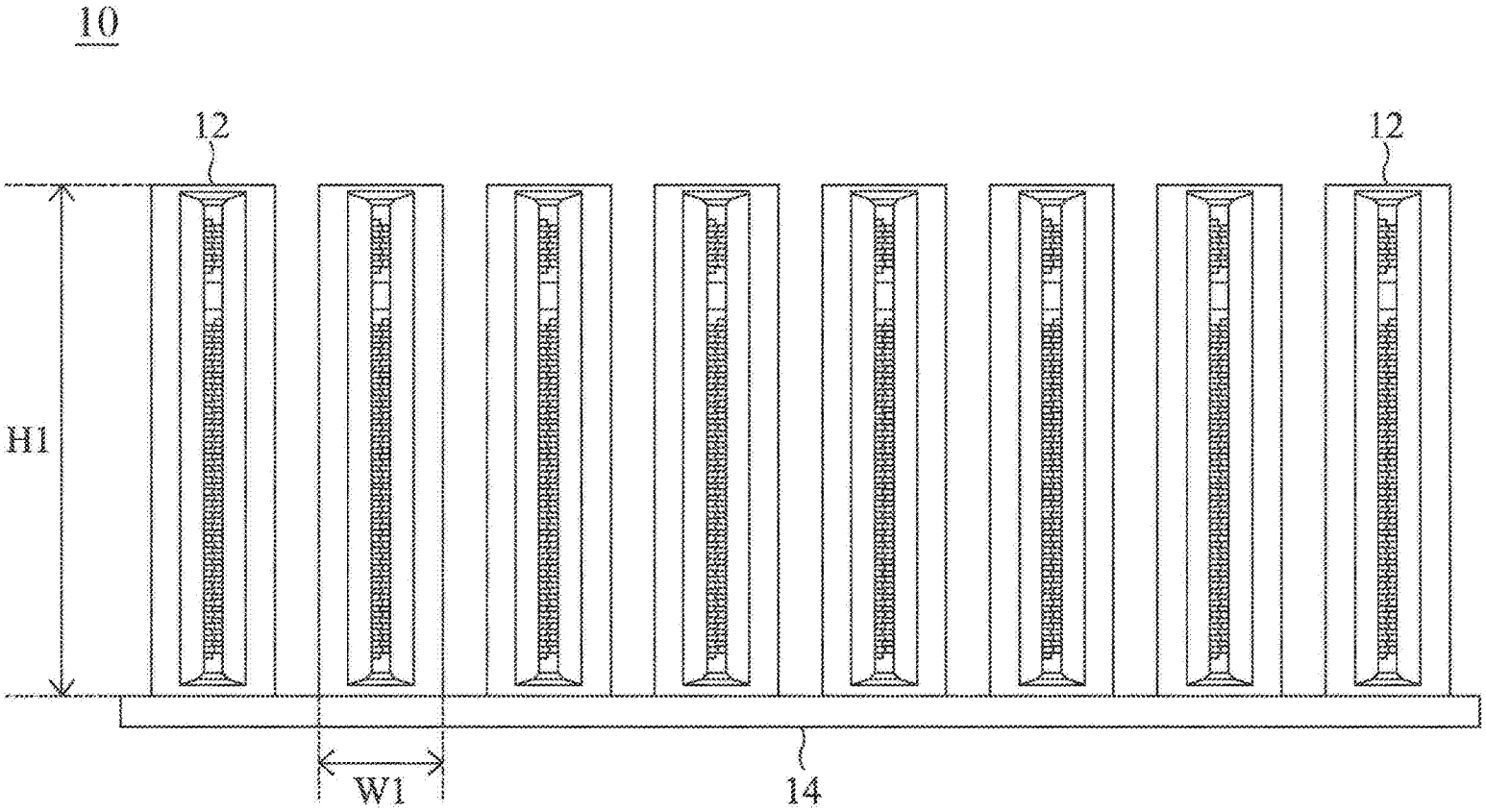
FIG. 1 PRIOR ART
FIG. 1 is a structural schematic view of an electrical connector assembly in prior art.
Figure 2:
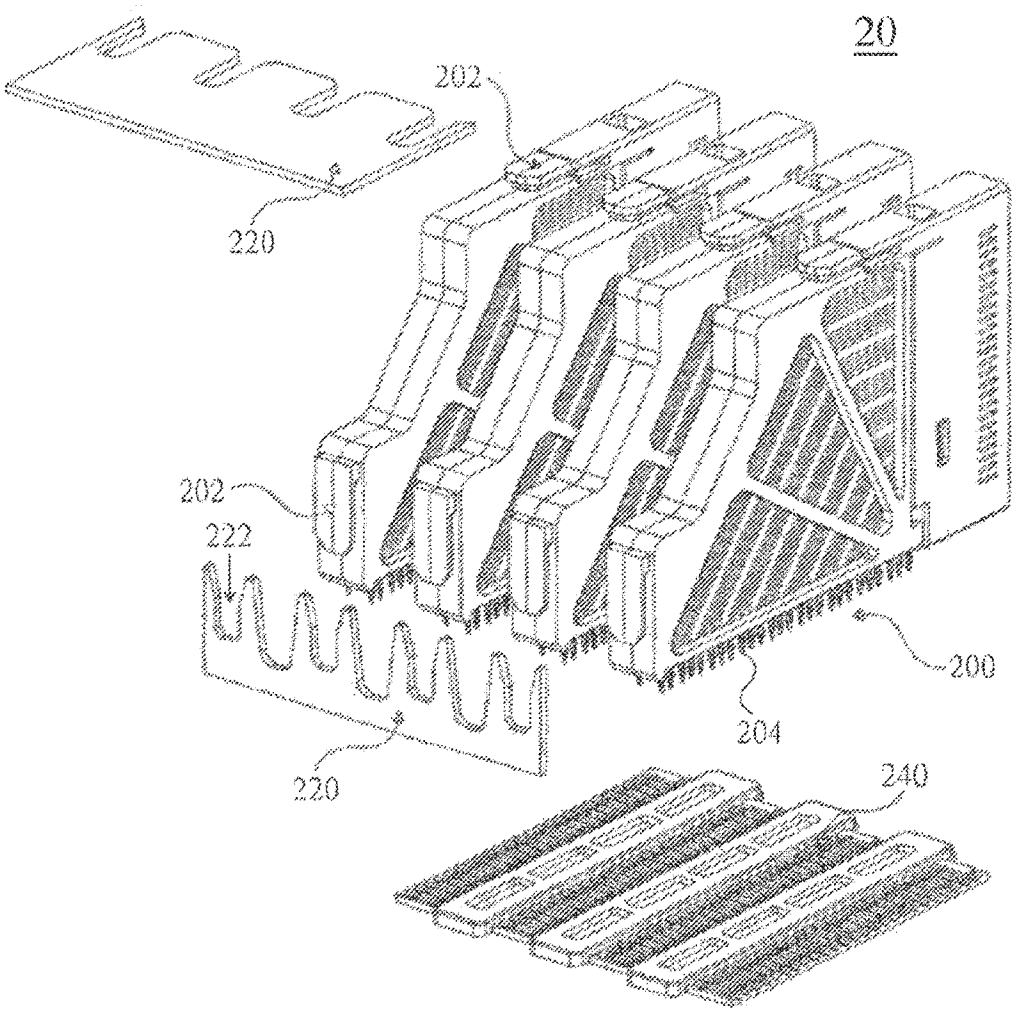
FIG. 2 PRIOR ART
FIG. 2 is a structural schematic view of an electrical connector assembly in prior art.
Figure 3:
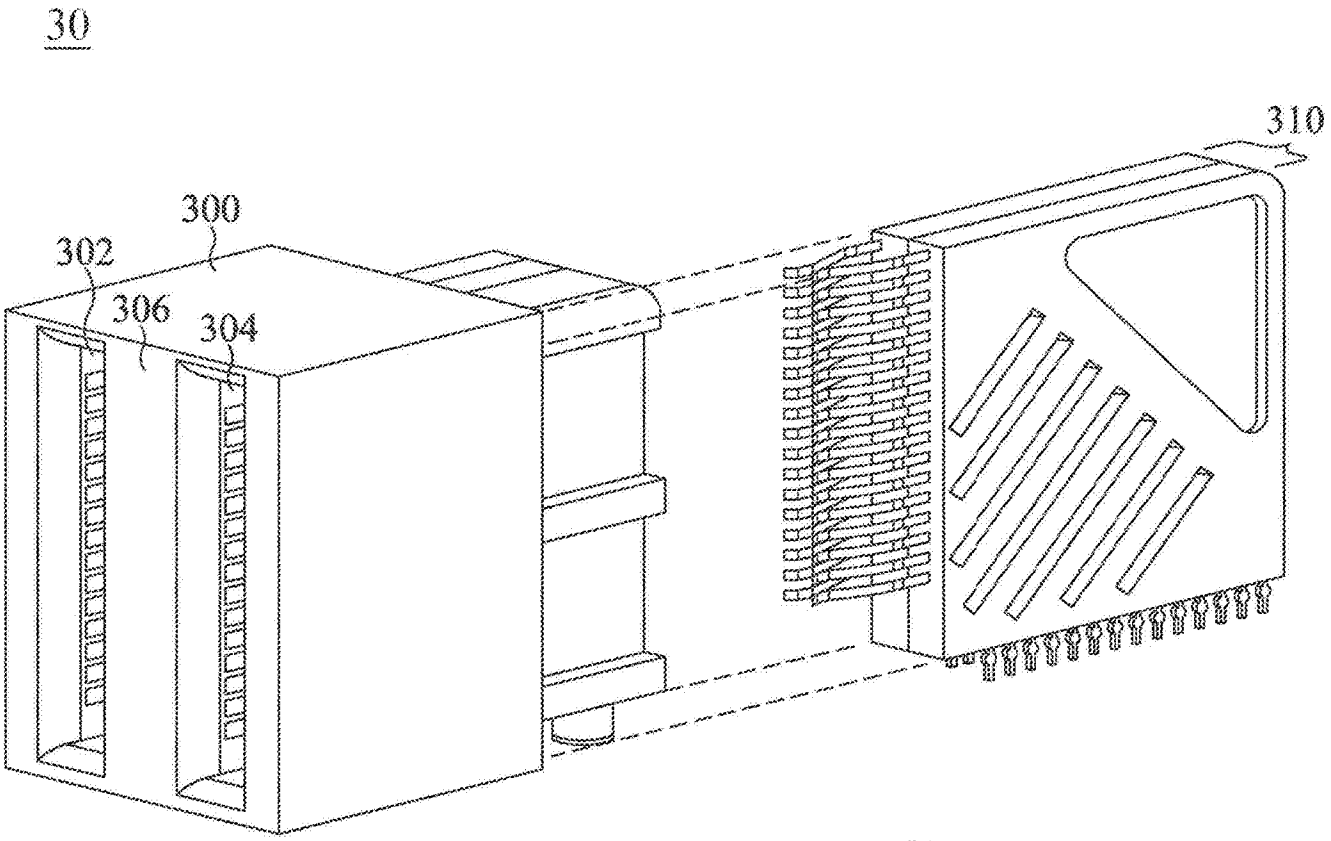
FIG. 3 PRIOR ART
FIG. 3 is a structural schematic view of an electrical connector assembly in prior art.
Figure 4:
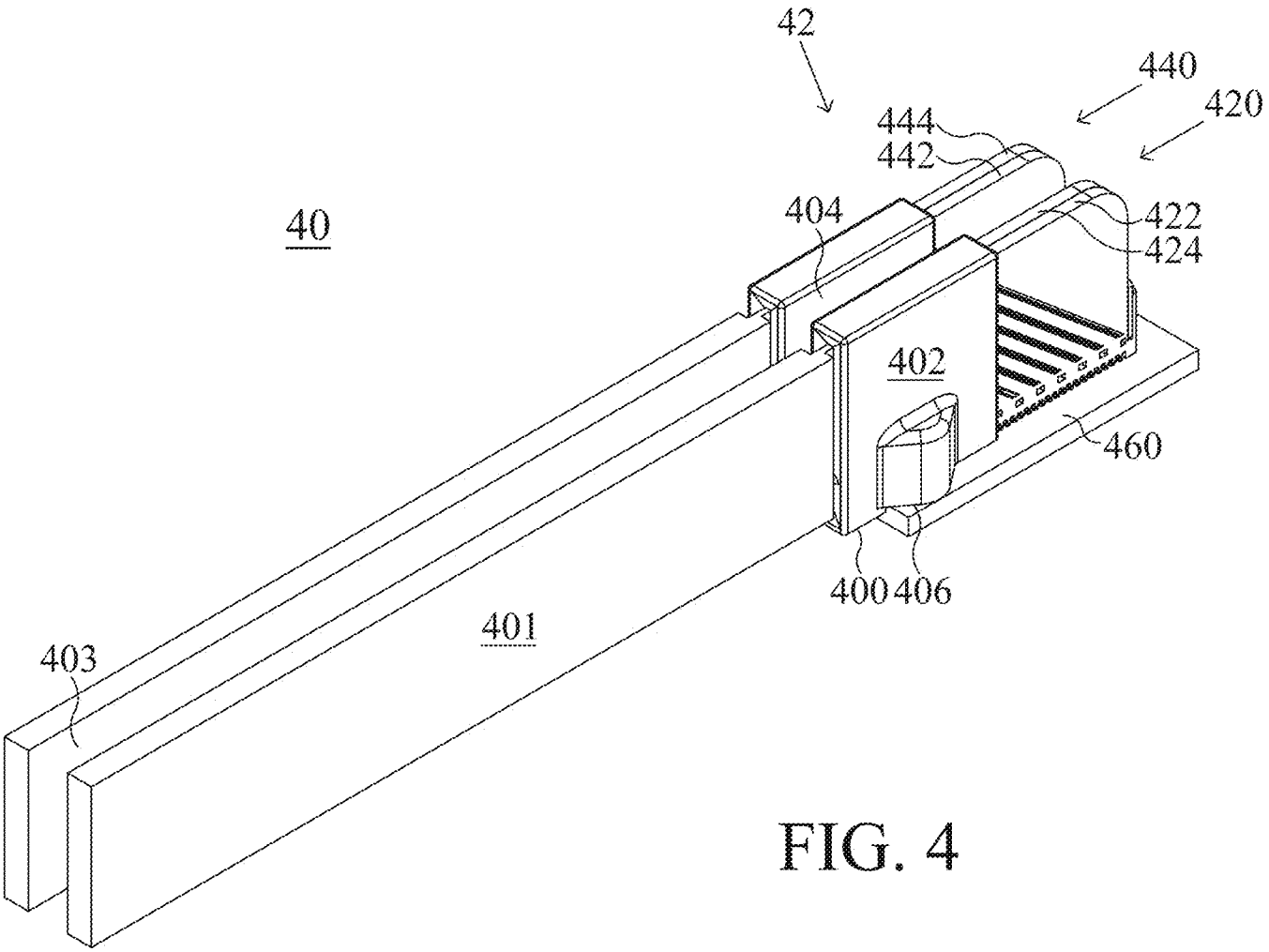
FIG. 4 is a structural schematic view of an electrical connector assembly according to some embodiments of the present disclosure.

FIG. 4 is a structural schematic view of an electrical connector assembly 40 according to some embodiments of the present disclosure. Referring to FIG. 4, the electrical connector assembly 40 comprises an electrical connector 42, a first card edge module 401, a second card edge module 403 and a circuit board 460. The first card edge module 401 and the second card edge module 403 are electrically connected to the circuit board 460 by the electrical connector 42. When the electrical connector 42 electrically connects the first card edge module 401 (and the second card edge module 403) and the circuit board 460, an extending direction of a card edge of the first card edge module 401 and an extending direction of a board edge of the circuit board 460 are orthogonal to each other.

The electrical connector 42 comprises a shell 400, a first wafer group 420 and a second wafer group 440. The shell 400 comprises a first frame portion 402, a second frame portion 404 and a first supporting portion 406. The first supporting portion 406 is positioned at a first side of the shell 400.

The first wafer group 420 is electrically connected to the circuit board 460 and comprises a first wafer 422 and a second wafer 424. The second wafer group 440 is electrically connected to the circuit board 460 and comprises a first wafer 442 and a second wafer 444.

Figure 5:
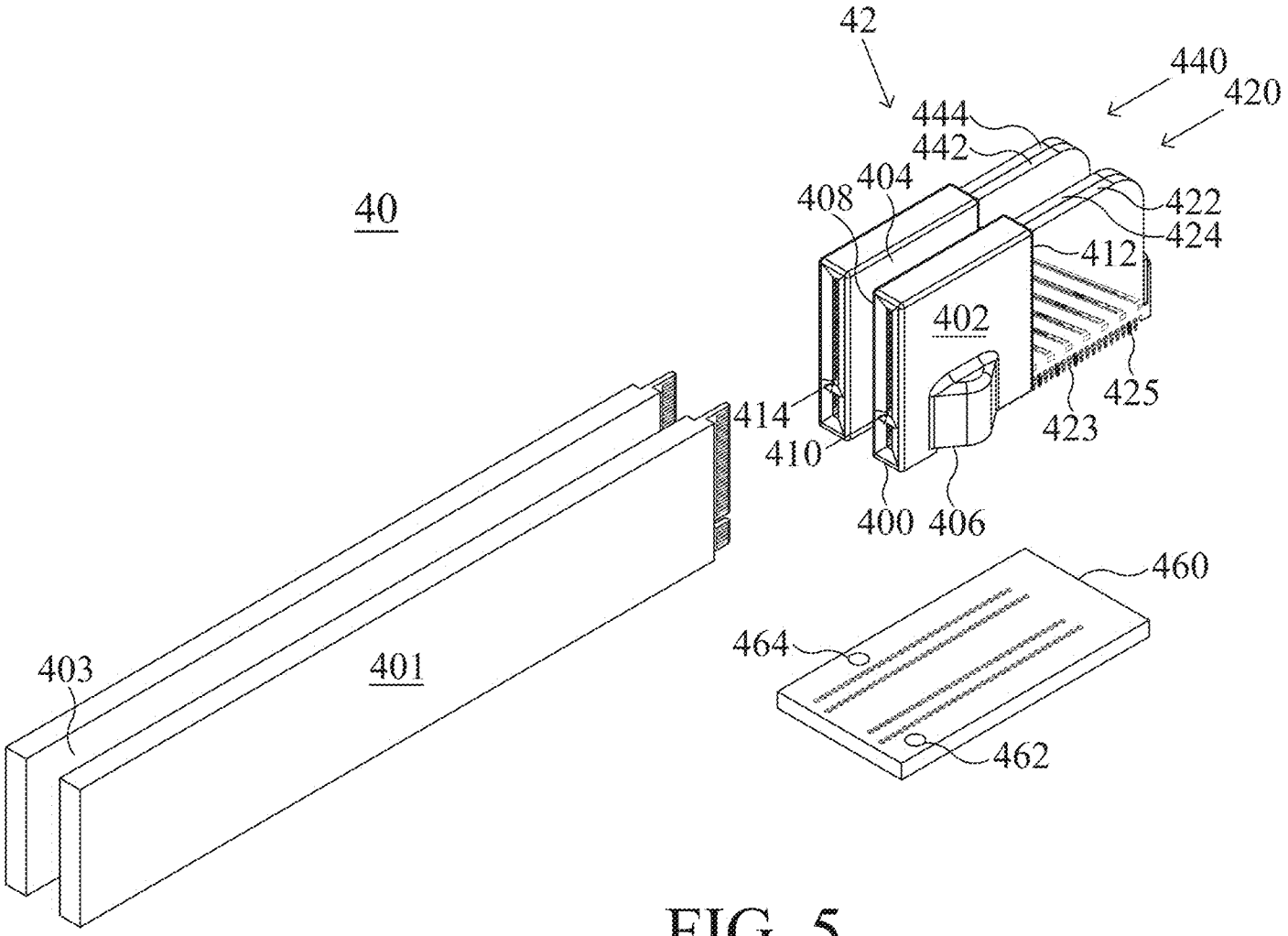
FIG. 5 is an exploded schematic view of the electrical connector assembly according to some embodiments of the present disclosure.

FIG. 5 is an exploded schematic view of the electrical connector assembly 40 according to some embodiments of the present disclosure. Referring to FIG. 5, the shell 400 is engaged with the circuit board 460 by means of a first through hole 462 and a second through hole 464 on the circuit board 460, which will be described in detailed with respect to FIG. 6. Moreover, the first frame portion 402 of the shell 400 defines a first slot 410 for receiving the first card edge module 401, the first slot 410 extends from a mating end 408 of the shell 400 to a mounting end 412 of the shell 400, the mating end 408 and the mounting end 412 are opposite to each other. Moreover, the second frame portion 404 of the shell 400 defines a second slot 414 for receiving the second card edge module 403, the second slot 414 extends from the mating end 408 of the shell 400 to the mounting end 412.

In addition, each of the first wafer group 420 and the second wafer group 440 comprises a plurality of terminals 425. The terminal 425 comprises a mounting portion 423 for electrically connecting with the circuit board 460.

Figure 6:
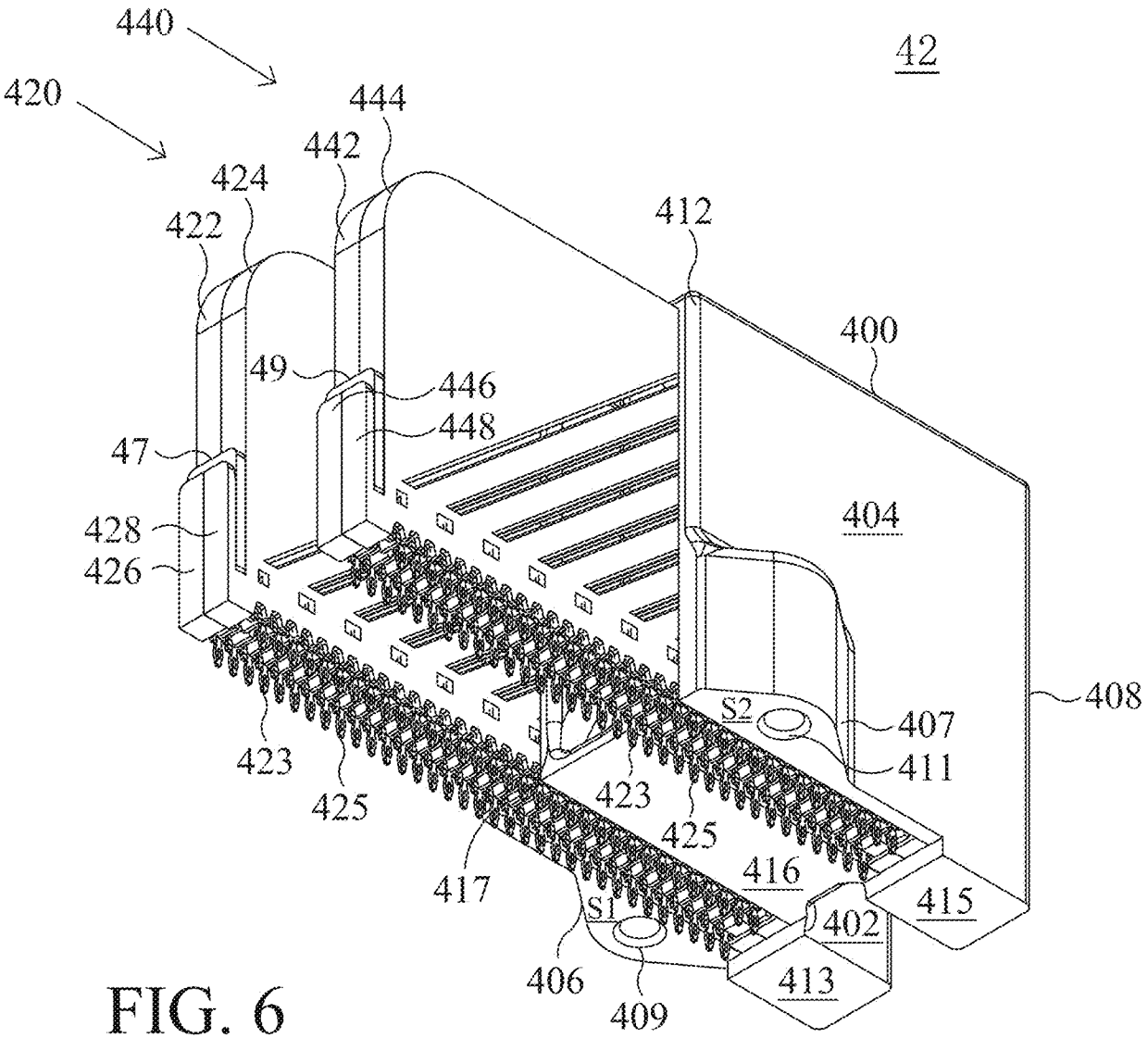
FIG. 6 is a structural schematic view of an electrical connector of FIG. 5 according to some embodiments of the present disclosure.

FIG. 6 is a structural schematic view of the electrical connector 42 of FIG. 5 according to some embodiments of the present disclosure. Referring to FIG. 6, in addition to the first supporting portion 406, the first frame portion 402 and the second frame portion 404, the shell 400 further comprises a bridging portion 417 and a second supporting portion 407.

The bridging portion 417 is positioned between the first frame portion 402 and the second frame portion 404 for connecting the first frame portion 402 and the second frame portion 404. A structure of the bridging portion 417 is clearly illustrated in FIG. 7. The bridging portion 417 has a bottom surface 416.

The second supporting portion 407 is similar to the first supporting portion 406 in function and structure. The second supporting portion 407 is positioned at a second side of the shell 400 (the second side is opposite to the first side), and has a screw hole 411 extending upwardly from a bottom surface S2, the screw hole 411 corresponds to the second through hole 464 on the circuit board 460 (see FIG. 5). Therefore, the second supporting portion 407 may be fixed on the circuit board 460 by a screw passing through the second through hole 464 on the circuit board 460 and in turn passing through the screw hole 411 of the second supporting portion 407.

Similarly, the first supporting portion 406 has a screw hole 409 extending upwardly from a bottom surface S1, the screw hole 409 corresponds to the first through hole 462 of the circuit board 460 (see FIG. 5). Therefore, the first supporting portion 406 may be fixed on the circuit board 460 by a screw passing through the first through hole 462 on the circuit board 460 and in turn passing through the screw hole 409 of the first supporting portion 406.

Moreover, electrical connector 42 further comprises a first fixing member 47 and a second fixing member 49. The first fixing member 47 is used to assemble the first wafer 422 and the second wafer 424 as the first wafer group 420 by engaging with and fixing a fixing portion 426 of the first wafer 422 and the fixing portion 428 of the second wafer 424. Similarly, the second fixing member 49 is used to assemble the first wafer 442 and the second wafer 444 as the second wafer group 440 by engaging with and fixing a fixing portion 446 of the first wafer 442 and a fixing portion 448 of the second wafer 444.

Figure 7:
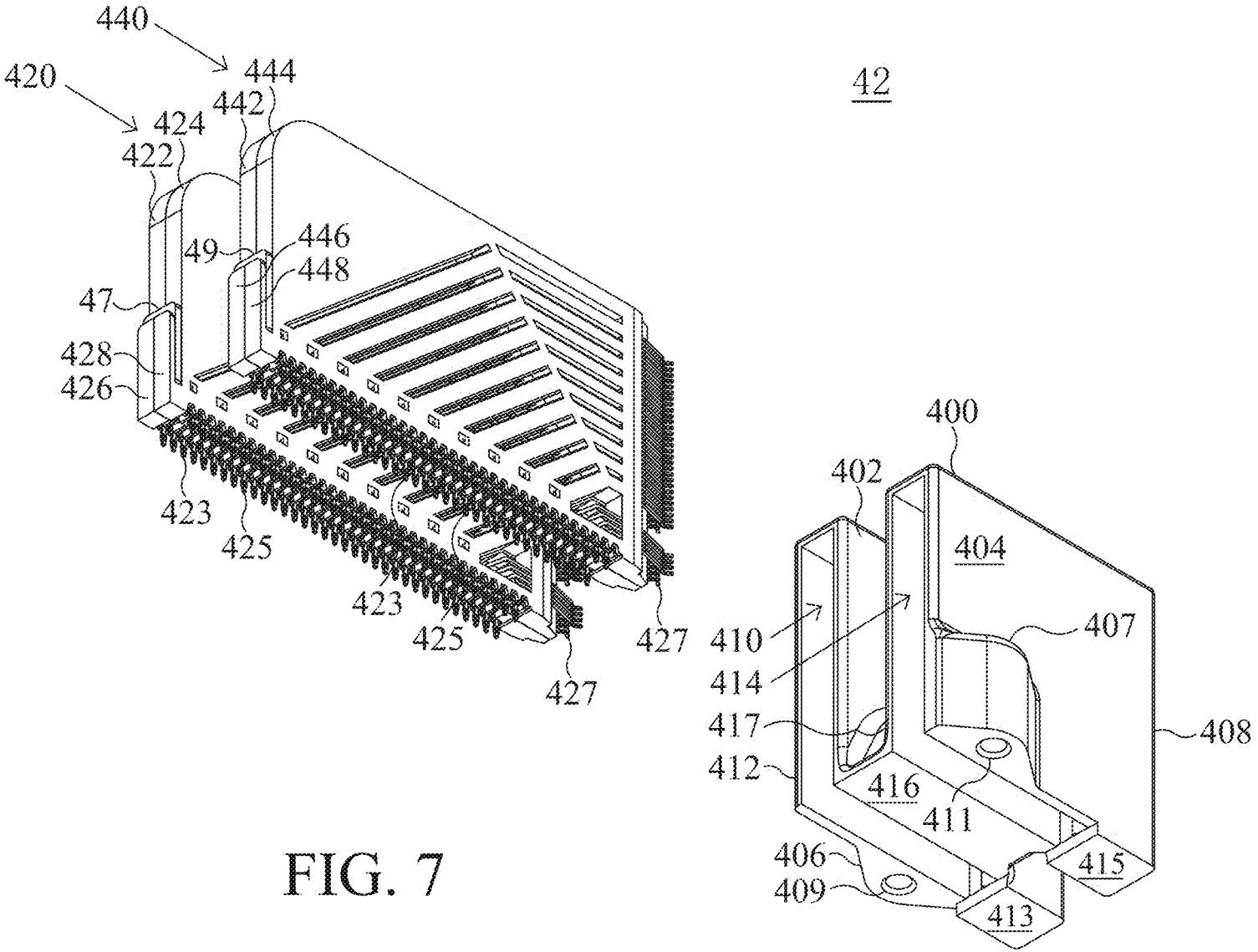
FIG. 7 is an exploded schematic view of the electrical connector of FIG. 6 according to some embodiments of the present disclosure.

FIG. 7 is an exploded schematic view of the electrical connector 42 of FIG. 6 according to some embodiments of the present disclosure. Referring to FIG. 7, the first wafer group 420 will be assembled to the first slot 410, mating portions 427 of the terminals 425 of the first wafer 422 and mating portions 427 of the terminals 425 of the second wafer 424 in the first wafer group 420 will be respectively positioned at two sides of the first slot 410. Similarly, the second wafer group 440 will be assembled to the second slot 414, mating portions 427 of the terminals 425 of the first wafer 442 and mating portions 427 of the terminals 425 of the second wafer 444 in the second wafer group 440 will be respectively positioned at two sides of the second slot 414.

Figure 8:
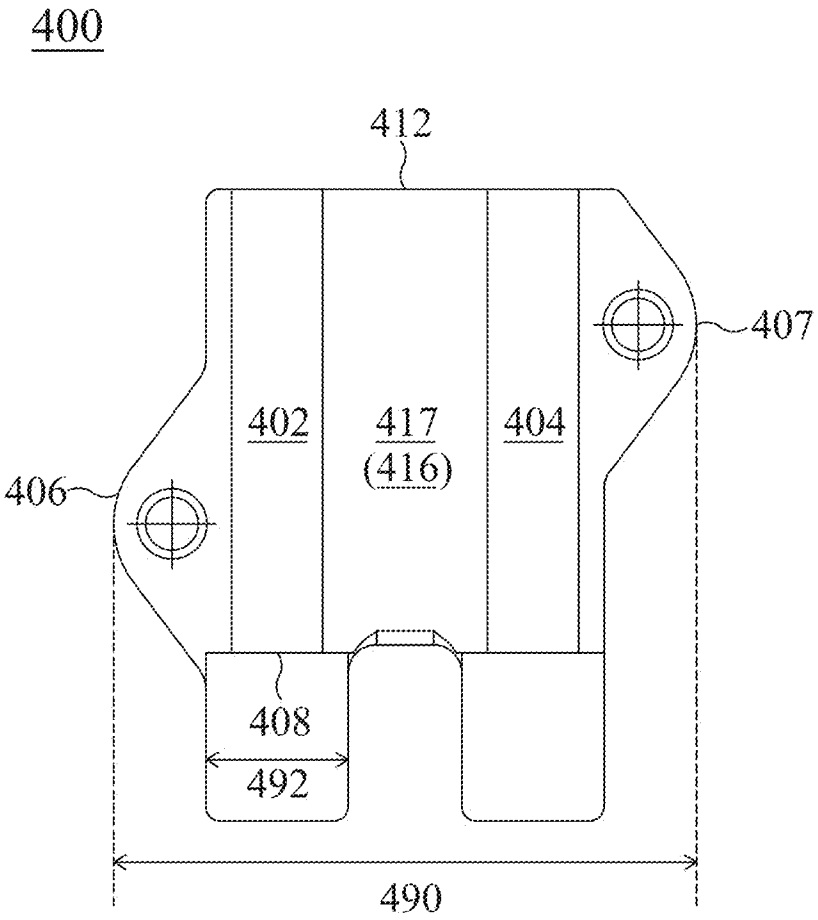
FIG. 8 is a bottom view of a shell of FIG. 7 according to some embodiments of the present disclosure.

FIG. 8 is a bottom view of the shell 400 of FIG. 7 according to some embodiments of the present disclosure. Referring to FIG. 8, the first supporting portion 406 is close to the mating end 408 of the shell 400 relative to the second supporting portion 407, and the second supporting portion 407 is close to the mounting end 412 of the shell 400 relative to the first supporting portion 406. Therefore, when an electrical connector assembly comprises two electrical connectors 42 of the present disclosure, the electrical connector assembly can have relative small volume, which will be described in detailed with respect to FIG. 9. Moreover, a contact area between the electrical connector 42 and the circuit board 460 in the present disclosure is in proportion to a width 490. Because the width 490 is relatively large, before the electrical connector 42 is fixed to the circuit board 460 by a fixing operation (for example, soldering operation), the electrical connector 42 does not relatively easily shake and can be relatively stably placed on the circuit board 460.

Reversely, in some electrical connectors in prior art, a contact area between an electrical connector and a circuit board is essentially equivalent to a width of a frame portion (for example, the width 492 of the first frame portion 402). Because the width of the frame portion of the electrical connector in prior art (for example, the width 492) is relatively small, before the electrical connector in prior art is fixed to the circuit board by a fixing operation (for example, soldering operation), the electrical connector in prior art easily shakes and can not be relatively stably placed on the circuit board.

Figure 9:
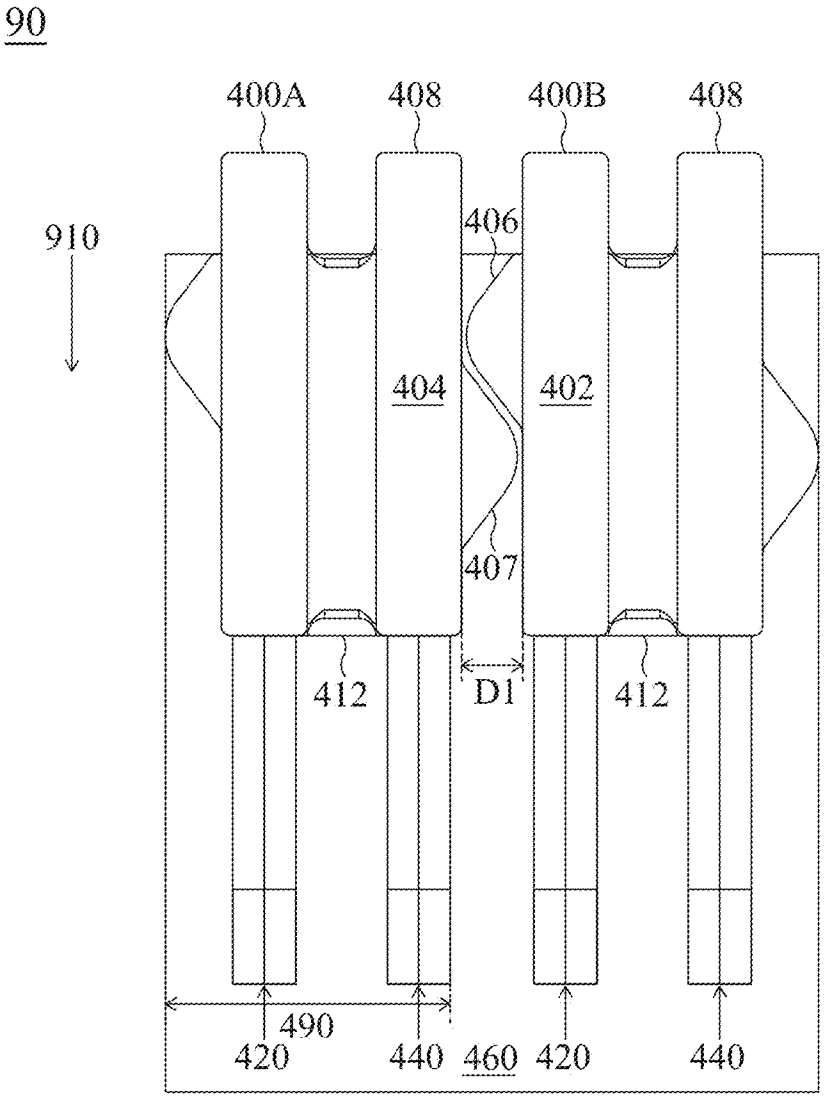
FIG. 9 is a structural schematic view of another electrical connector assembly according to some embodiments of the present disclosure.

FIG. 9 is a structural schematic view of another electrical connector assembly 90 according to some embodiments of the present disclosure. Referring to FIG. 9, the electrical connector assembly 90 is similar to the electrical connector assembly 40 as shown in FIG. 4, a difference lies in that the electrical connector assembly 90 comprises two electrical connectors 400. For sake of convenient description, the two electrical connectors 400 are respectively referred to as a first electrical connector 400A and a second electrical connector 400B. As described in the embodiment of FIG. 8, because the first supporting portion 406 is close to the mating end 408 of the shell 400 relative to the second supporting portion 407 and the second supporting portion 407 is close to the mounting end 412 of the shell 400 relative to the first supporting portion 406, the second supporting portion 407 of the first electrical connector 400A and the first supporting portion 406 of the second electrical connector 400B can be arranged front-back along a card insertion direction 910 of the first card edge module 401, which allows a distance D1 between the second frame portion 404 of the first electrical connector 400A and the first frame portion 402 of the second electrical connector 400B is relatively small. Therefore, the electrical connector assembly 90 occupies a relatively small area in a plane perpendicular to the card insertion direction 910 of the first card edge module 401.

Figure 10:
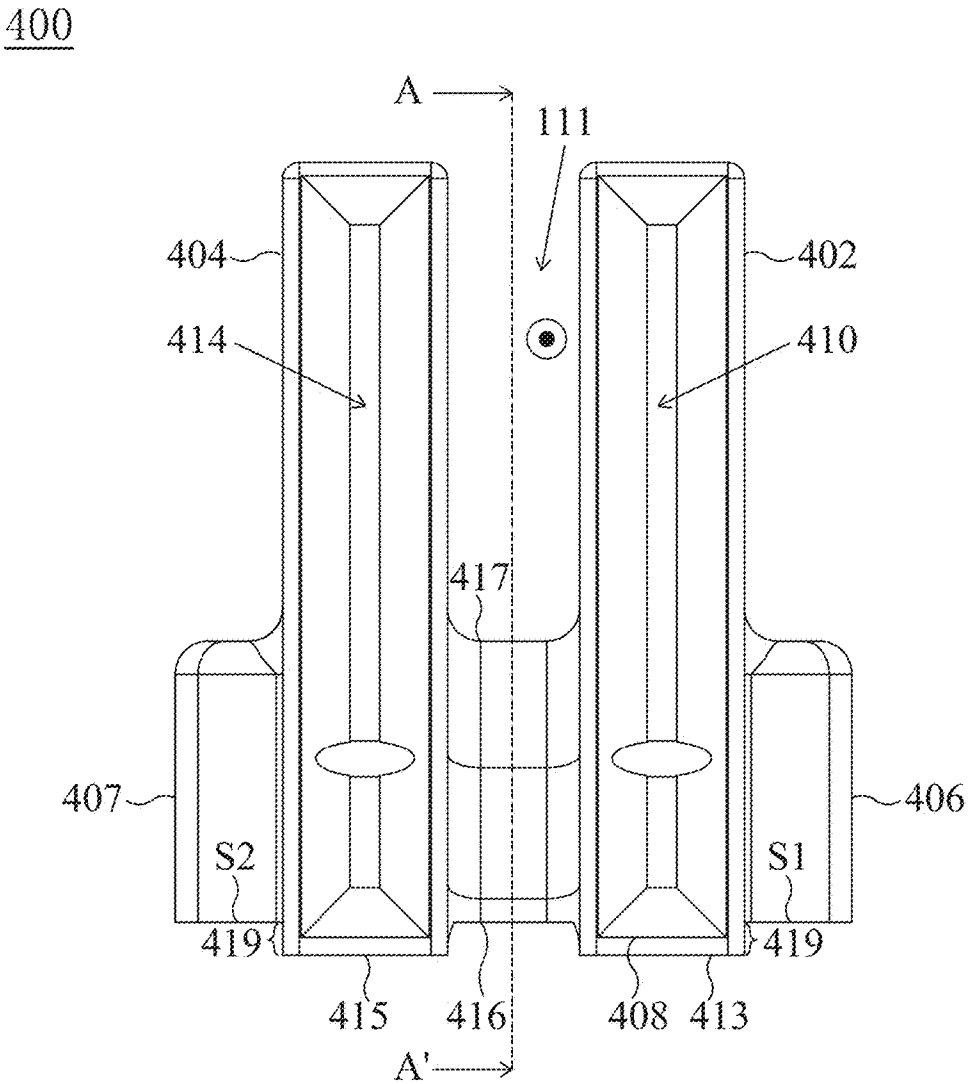
FIG. 10 is a front view of the shell of FIG. 7 according to some embodiments of the present disclosure.

FIG. 10 is a front view of the shell 400 of FIG. 7 according to some embodiments of the present disclosure. Referring to FIG. 10, the bridging portion 417, the first frame portion 402 and the second frame portion 404 cooperatively define an air flow channel 111 above the bridging portion 417. Therefore, because there is the air flow channel 111 defined by the bridging portion 417, the first frame portion 402 and the second frame portion 404, air can flow between the first frame portion 402 and the second frame portion 404, heat dissipation effect of the electrical connector 42 of the present disclosure is relatively better.

In some electrical connectors in prior art, there is not any air flow channel between a first frame portion defining a first slot for receiving a first card edge module (similar to the first frame portion 402 of the present disclosure) and a second frame portion defining a second slot for receiving a second card edge module (similar to the second frame portion 404 of the present disclosure). For example, the electrical connector in prior art has a connecting solid face for connecting the first frame portion and the second frame portion. Because the connecting solid face, for example, is orthogonal to air flow direction in structure, flowing of air will be blocked. Therefore, heat dissipation effect of the electrical connector in prior art is worse.

Moreover, in the present embodiment, each of the first frame portion 402 and the second frame portion 404 further comprises an extension portion 419. The extension portions 419 are immediately adjacent to the mating end 408 of the shell 400, and are formed by extending downwardly from a bottom surface of the first frame portion 402 and a bottom surface of the second frame portion 404. Because there are the extension portions 419, a length of the first frame portion 402 and a length of the second frame portion 404 are relatively longer, which allows a bottom surface 413 of the extension portion 419 of the first frame portion 402 and a bottom surface 415 of the extension portion 419 of the second frame portion 404 are lower than the bottom surface S1 of the first supporting portion 406 and the bottom surface S2 of the second supporting portion 407. However, the present disclosure is not limited to this. Because the length of the first frame portion 402 and the length of the second frame portion 404 are relatively longer, a length of the first slot 410 and a length of the second slot 414 may be lengthened, in a case that a pitch between the mating portions 427 of the terminals 425 is constant, the first slot 410 and the second slot 414 can receive more terminals.

Figure 11:
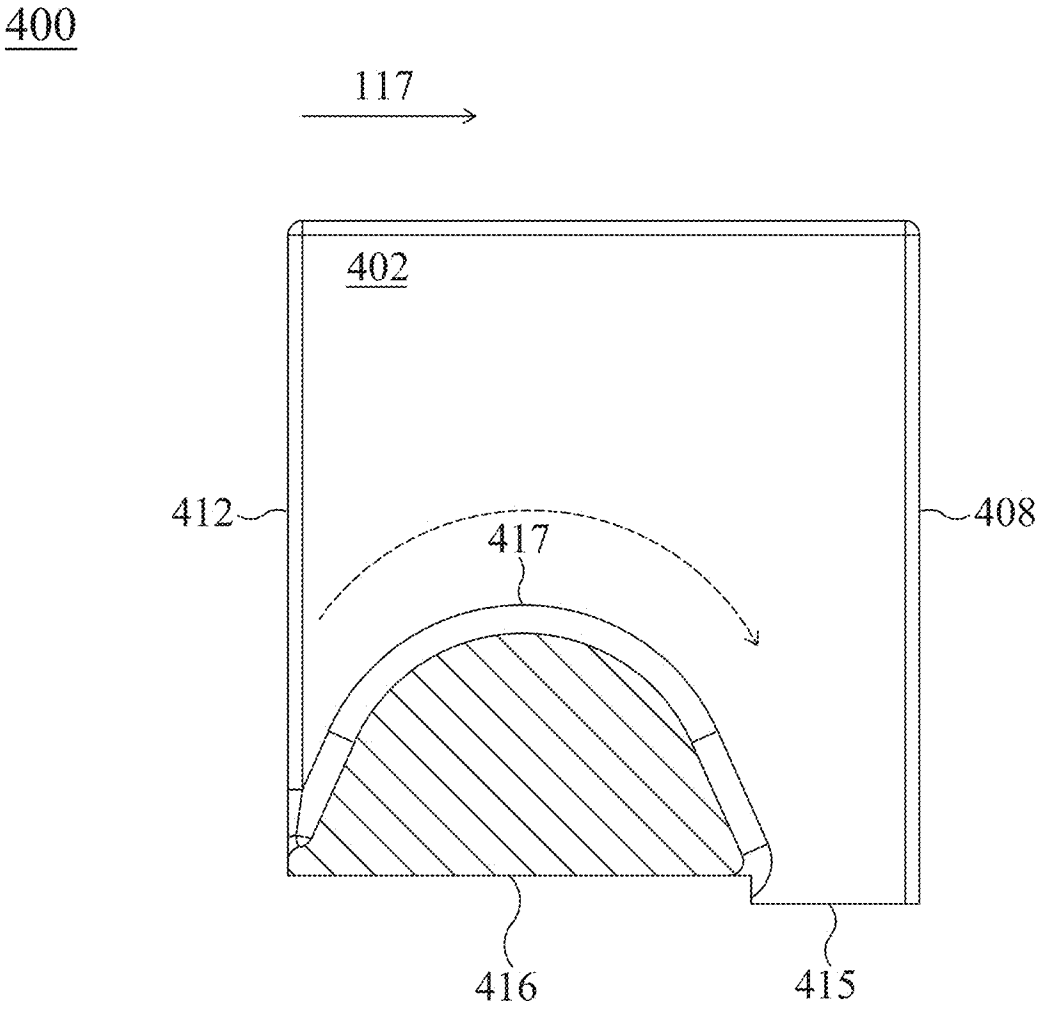
FIG. 11 is a cross sectional schematic view of the shell of FIG. 7 along a cross sectional line A-A' according to some embodiments of the present disclosure.

FIG. 11 is a cross sectional schematic view of the shell 400 of FIG. 7 along a cross sectional line A-A' according to some embodiments of the present disclosure. Referring to FIG. 11, the bridging portion 417 (also see FIG. 7) has an arch guide surface along a card insertion direction 117 in which the first card edge module 401 is inserted into the first slot 410. Because there is the arch guide surface, heat dissipation effect of the electrical connector 42 is relatively better.

Figure 12:
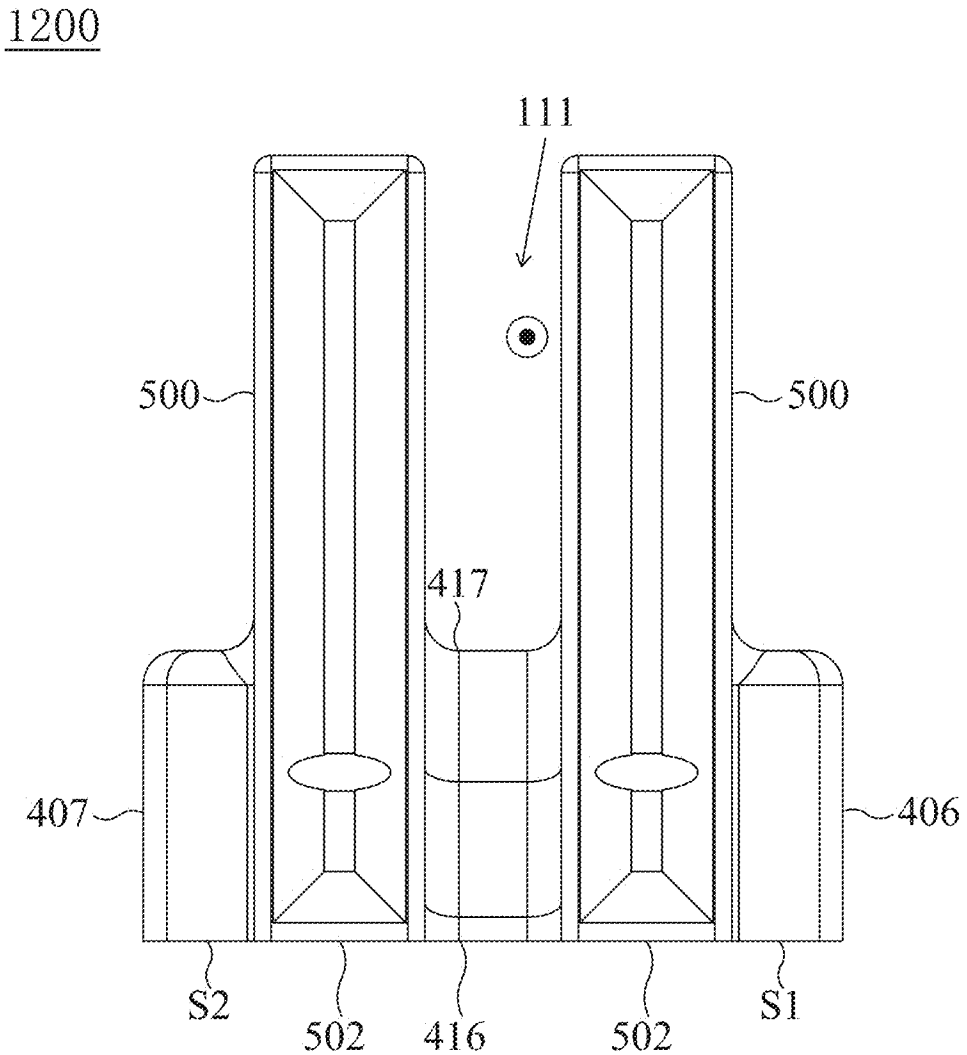
FIG. 12 is a front view of another shell according to some embodiments of the present disclosure.

FIG. 12 is a front view of another shell 1200 according to some embodiments of the present disclosure. Referring to FIG. 12, the shell 1200 is similar to the shell 400 as shown in FIG. 10, a difference lies in that the shell 1200 comprises two frame portions 500. The frame portions 500 are similar to the first frame portion 402 and the second frame portion 404 as shown in FIG. 10, a difference lies in that the frame portions 500 remove the extension portion 419 of the first frame portion 402 and the extension portion 419 of the second frame portion 404 as shown in FIG. 10. Therefore, bottom surfaces 502 of the frame portion 500 are flush with the bottom surface S1 of the first supporting portion 406 and the bottom surface S2 of the second supporting portion 407, also are flush with the bottom surface 416 of the bridging portion 417.

Figure 13:
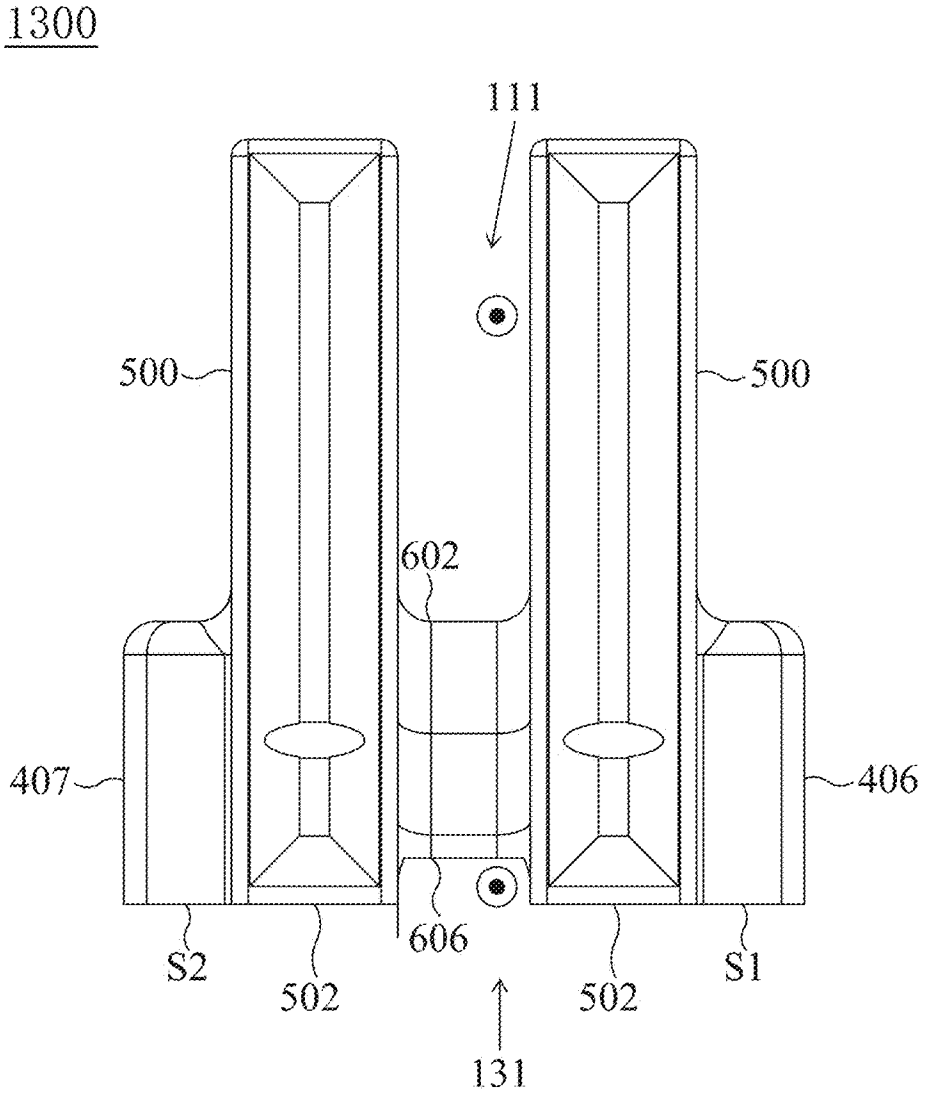
FIG. 13 is a front view of still another shell according to some embodiments of the present disclosure.

FIG. 13 is a front view of still another shell 1300 according to some embodiments of the present disclosure. Referring to FIG. 13, the shell 1300 is similar to the shell 1200 as shown in FIG. 12, a difference lies in that the shell 1300 comprises a bridging portion 602. A bottom surface 606 of the bridging portion 602 is higher than the bottom surfaces 502 of the frame portions 500. Therefore, the bridging portion 602 and the two frame portions 500 define another air flow channel 131 below the bottom portion 606 of the bridging portion 602. Because the shell 1300 of FIG. 13 defines the two air flow channels 111, 131, therefore heat dissipation effect of the shell 1300 is relatively better.

Figure 14:
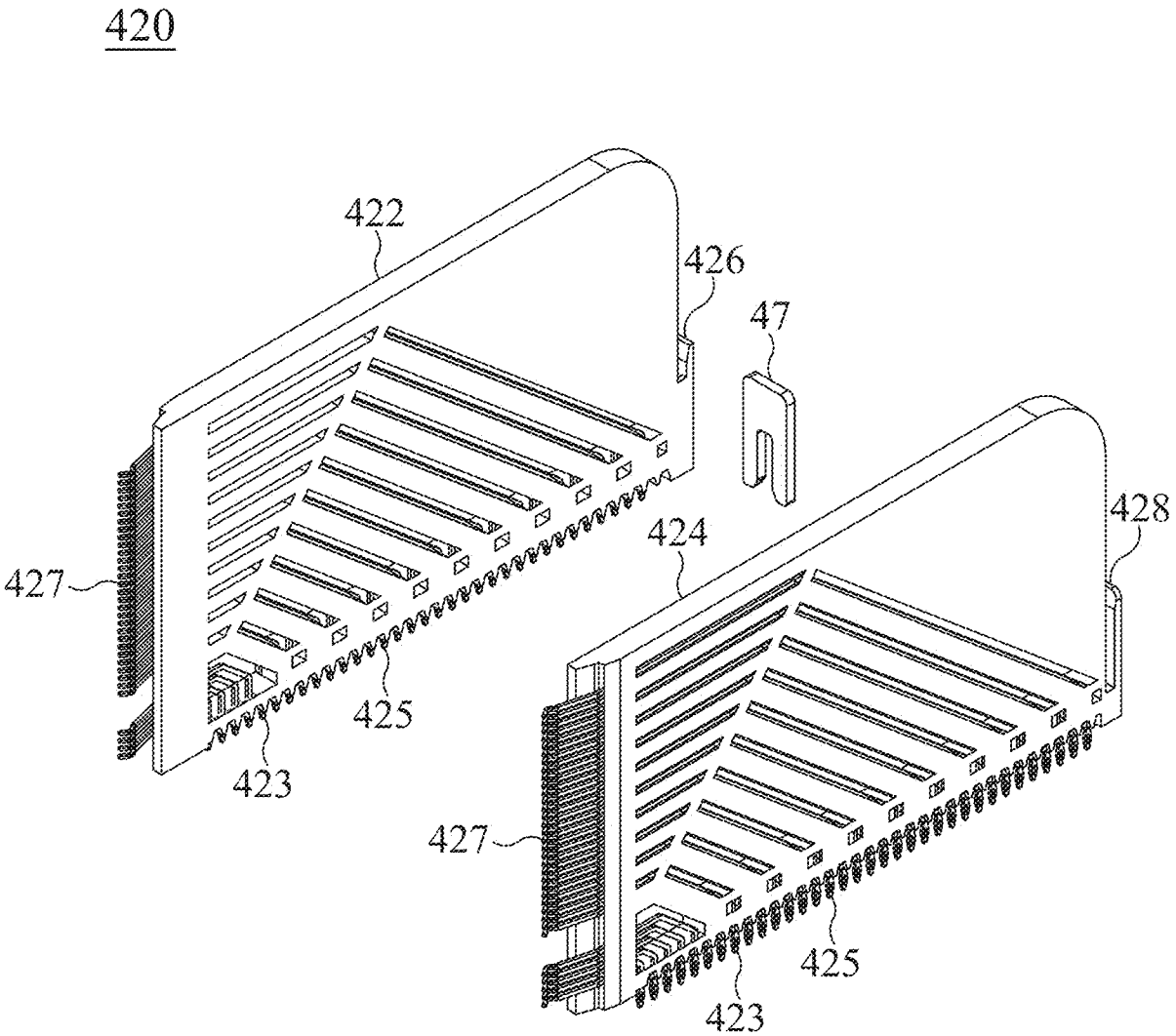
FIG. 14 is an exploded schematic view of a first wafer group of FIG. 7 according to some embodiments of the present disclosure.

FIG. 14 is an exploded schematic view of the first wafer group 420 of FIG. 7 according to some embodiments of the present disclosure. Referring to FIG. 14, as described with respect to FIG. 4, the first wafer group 420 comprises the first wafer 422 and the second wafer 424. Moreover, the first wafer group 420 and the second wafer group 440 have the same function and structure, so detailed description is omitted herein.

Figure 15:
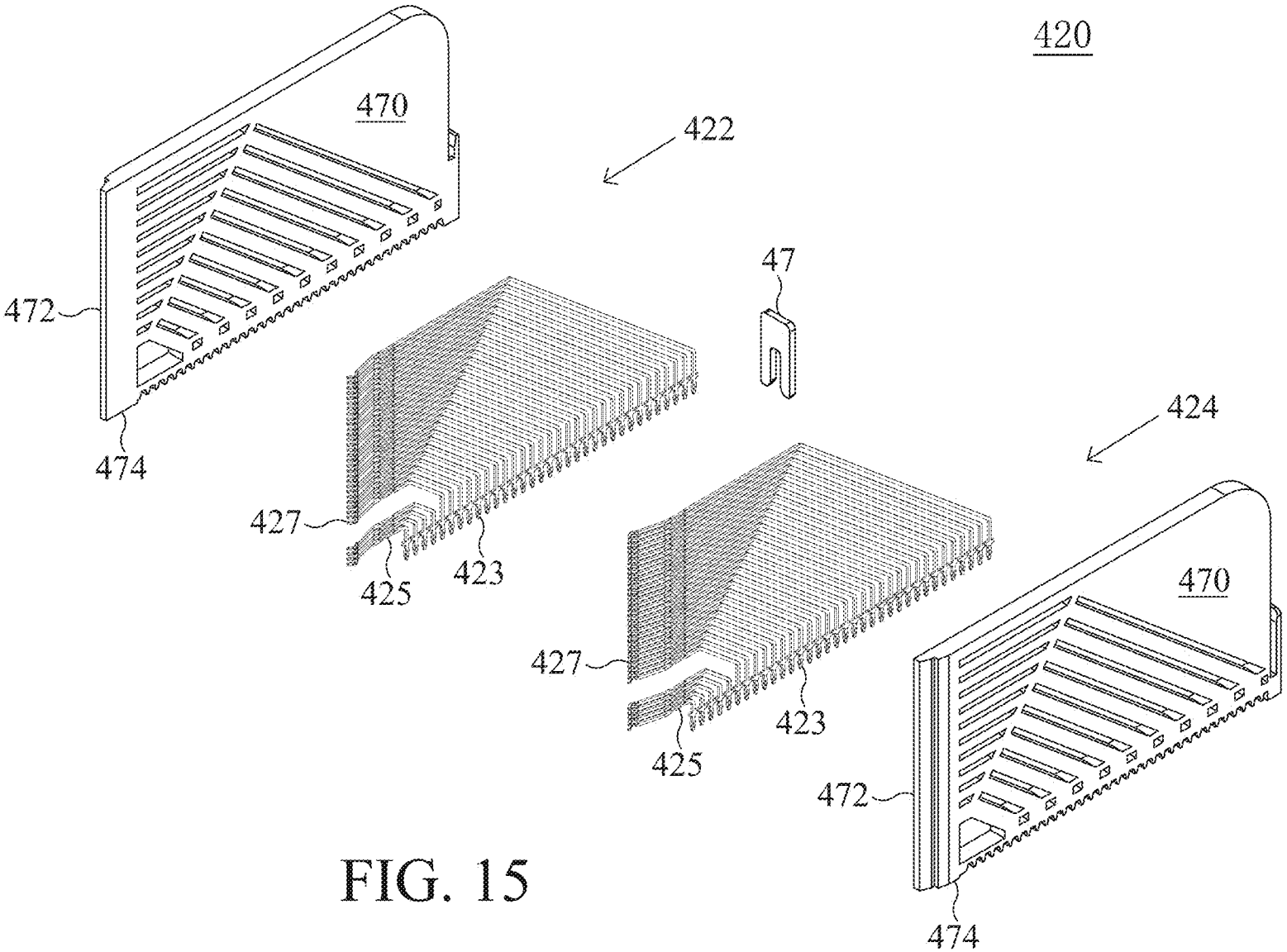
FIG. 15 is a further exploded schematic view of the first wafer group of FIG. 7 according to some embodiments of the present disclosure.

FIG. 15 is a further exploded schematic view of the first wafer group 420 of FIG. 7 according to some embodiments of the present disclosure. Referring to FIG. 15, each of the first wafer 422 and the second wafer 424 comprises a wafer housing 470. The wafer housing 470 has a mounting face 474 and a mating face 472, the mounting face 474 is perpendicular to the mating face 472. The first wafer group 420 is assembled to the first slot 410 by the mating faces 472 of the wafer housings 470 from the mounting end 412 of the shell 400. Similarly, the mating faces 472 of the wafer housings 470 of the second wafer group 440 are assembled to the second slot 414 from the mounting end 412 of the shell 400.

Moreover, as described with respect to FIG. 5, the first wafer group 420 comprises the plurality of terminals 425. More specifically, each of the first wafer 422 and the second wafer 424 of the first wafer group 420 comprises terminals 425. As shown in FIG. 15, the mounting portions 423 of the terminals 425 will be positioned at the mounting faces 474 of the wafer housings 470, the mating portions 427 of the terminals 425 will be positioned at the mating faces 472 of the wafer housings 470 and electrically connected to the first card edge module 401.

Figure 16:
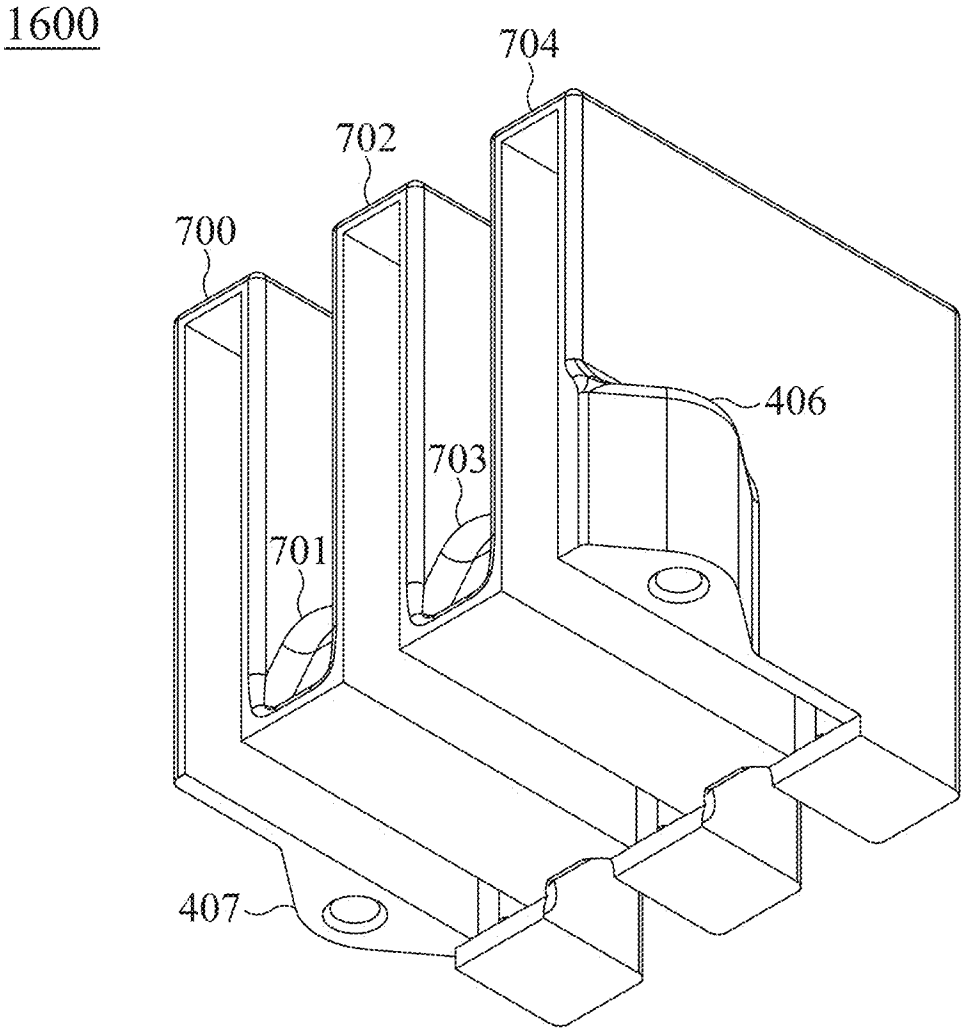
FIG. 16 is further another shell according to the present disclosure an embodiment.

FIG. 16 is further another shell 1600 according to an embodiment of the present disclosure. Referring to FIG. 16, the shell 1600 is similar to the shell 400 as shown in FIG. 7, a difference lies in that the shell 1600 comprises three frame portions 700, 702, 704, a first bridging portion 701 and a second bridging portion 703. The shell 1600 is basically similar to the shell 400 as show in FIG. 7 in function and detailed structure, therefore detailed description is omitted herein.

Because the shell of the present disclosure may comprise two frame portions or three frame portions, the shell of the present disclosure can be applicable to an electrical connector having various number of card edge modules. For example, if the electrical connector needs to connect five card edge modules, it only needs to combine one shell 400 and one shell 1600. Therefore, the design of the shell of the present disclosure can allow the electrical connector to be applied more widely.

Figure 17:
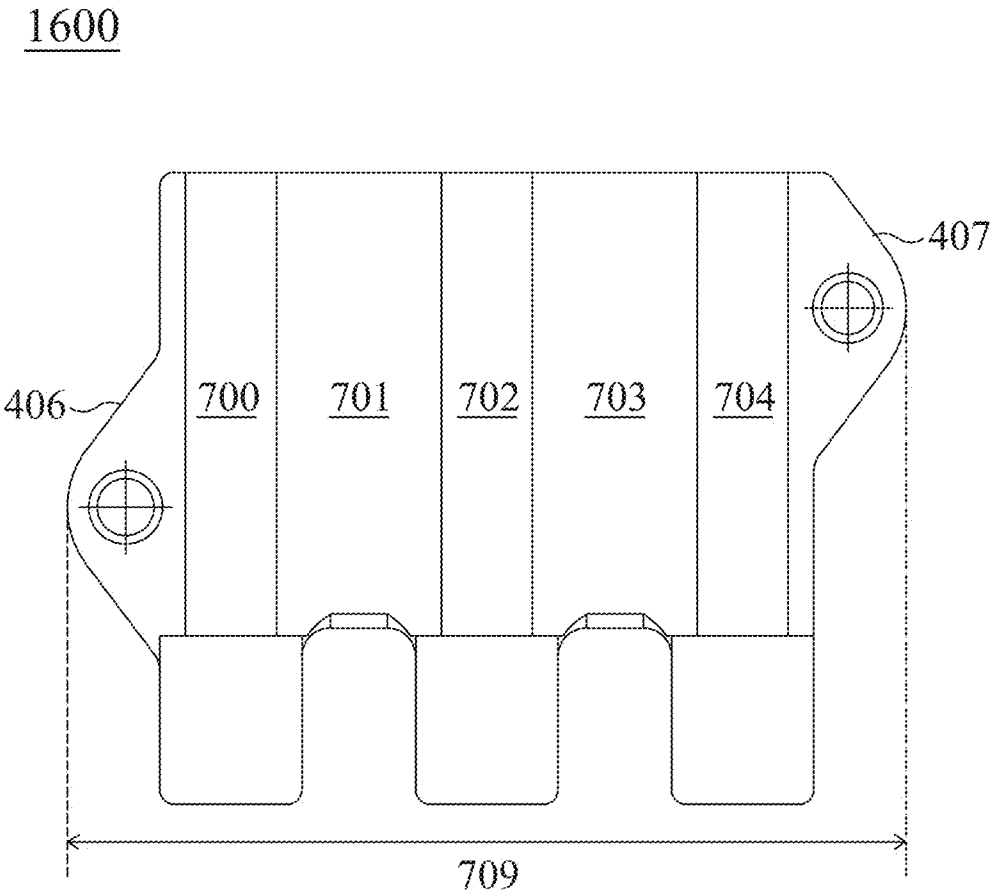
FIG. 17 is a bottom view of a shell of FIG. 6 according to some embodiments of the present disclosure.

FIG. 17 is a bottom view of the shell 1600 of FIG. 16 according to some embodiments of the present disclosure. Referring to FIG. 17, a contact area between the electrical connector using the shell 1600 and the circuit board is in proportion to a width 709 of the shell 1600. Because the width 709 is relatively large, before the electrical connector comprising the shell 1600 is fixed to the circuit board by a fixing operation (for example, soldering operation), the electrical connector comprising the shell 1600 does not relatively easily shake and can be relatively stably placed on the circuit board.

Moreover, because the first supporting portion is close to the mating end of the shell relative to the second supporting portion and the second supporting portion is close to the mounting end of the shell relative to first supporting portion in the shell of the present disclosure, the second supporting portion of the first electrical connector and the first supporting portion of the second electrical connector can be arranged front-back along the card insertion direction of the first card edge module, which allows the distance between the first frame portion of the first electrical connector and the second frame portion of the second electrical connector to be relatively small. Therefore, the electrical connector assembly occupies a relatively small area along a direction perpendicular to the card insertion direction of the first card edge module.

Moreover, the bridging portion, the first frame portion and the second frame portion of the shell of the present disclosure cooperatively define an air flow channel above the bridging portion. Therefore, air can flow between the first frame portion and the second frame portion, which allows heat dissipation effect of the electrical connector of the present disclosure is relatively better.

The foregoing summarizes features of some embodiments, and thus, those skilled in the art may more understand the aspects of the present disclosure. Those skilled in the art should understand that the present disclosure may be easily used as a basis to design or modify other manufacturing methods and structures to achieve the same objects and/or achieve the same advantages as the embodiments of the present disclosure. Those skilled in the art also understand that these equivalent architectures do not depart from the spirit and scope of the present disclosure, and that various changes, substitutions and replacements can be made by those skilled in the art without departing from the spirit and scope of the present disclosure.

What is claimed is:

1. An electrical connector, comprising:

a shell, comprising:

a first frame portion defining a first slot;

a second frame portion defining a second slot;

a bridging portion connecting the first frame portion and the second frame portion, the bridging portion, the first frame portion and the second frame portion cooperatively defining an air flow channel;

a first supporting portion positioned at a first side of the shell; and a second supporting portion positioned at a second side of the shell, the second side being opposite to the first side;

a first wafer group assembled to the first slot; and a second wafer group assembled to the second slot, wherein each of the first wafer group and the second wafer group comprises a first wafer and a second wafer, each of the first wafer and the second wafer comprises a wafer housing, the wafer housing has a mounting face and a mating face, the mounting face is perpendicular to the mating face.

2. The electrical connector of claim 1, wherein the shell has a mounting end and a mating end, the mounting end and the mating end are opposite to each other, each of the first slot and the second slot extends to the mounting end and the mating end of the shell.

3. The electrical connector of claim 1, wherein the first wafer group and the second wafer group are respectively assembled to the first slot and the second slot by the mating faces of the wafer housings from the mounting end of the shell.

4. The electrical connector of claim 3, wherein each of the first wafer and the second wafer further comprises terminals, each of the terminals has a mounting portion and a mating portion, the mounting portion of each of the terminals is positioned at the mounting face of the wafer housing, and the mating portion of each of the terminals is positioned at the mating face of the wafer housing and electrically connected to a card edge module.

5. The electrical connector of claim 4, wherein the mating portions of the terminals of the first wafer and the mating portions of the terminals of the second wafer in the first wafer group are respectively positioned at two sides of the first slot.

6. An electrical connector, comprising:

a shell, comprising:

a first frame portion defining a first slot;

a second frame portion defining a second slot;

a bridging portion connecting the first frame portion and the second frame portion, the bridging portion, the first frame portion and the second frame portion cooperatively defining an air flow channel;

a first supporting portion positioned at a first side of the shell; and a second supporting portion positioned at a second side of the shell, the second side being opposite to the first side;

a first wafer group assembled to the first slot; and a second wafer group assembled to the second slot, wherein the first supporting portion is close to the mating end of the shell relative to the second supporting portion, and the second supporting portion is close to the mounting end of the shell relative to the first supporting portion.

7. The electrical connector of claim 6, wherein a bottom surface of the first supporting portion and a bottom surface of the second supporting portion are flush with a bottom surface of the first frame portion and a bottom surface of the second frame portion.

8. The electrical connector of claim 6, wherein a bottom surface of the bridging portion is flush with a bottom surface of the first frame portion and a bottom surface of the second frame portion.

9. The electrical connector of claim 6, wherein the bridging portion is higher than a bottom surface of the first frame portion and a bottom surface of the second frame portion;

the bridging portion, the first frame portion and the second frame portion define another air flow channel below a bottom surface of the bridging portion.

10. The electrical connector of claim 6, wherein the bridging portion has an arch guide surface along a card insertion direction in which a card edge module is inserted into the first slot.

11. The electrical connector of claim 1, wherein when the electrical connector is electrically connected to a card edge module and a circuit board, an extending direction of a card edge of the card edge module and an extending direction of a board edge of the circuit board are orthogonal to each other.

12. The electrical connector of claim 1, wherein each of the first supporting portion and the second supporting portion has a screw hole extending upwardly from a bottom surface of each of the first supporting portion and the second supporting portion, a circuit board independent of the electrical connector has a through hole corresponding to the screw hole.

13. An electrical connector, comprising:

a shell, comprising:

a first frame portion defining a first slot;

a second frame portion defining a second slot;

a bridging portion connecting the first frame portion and the second frame portion, the bridging portion, the first frame portion and the second frame portion cooperatively defining an air flow channel;

a first supporting portion positioned at a first side of the shell; and a second supporting portion positioned at a second side of the shell, the second side being opposite to the first side;

a first wafer group assembled to the first slot; and a second wafer group assembled to the second slot, wherein each of the first frame portion and the second frame portion further comprises an extension portion, the extension portion is immediately adjacent to the mating end of the shell, and is formed by extending downwardly from a bottom surface of each of the first frame portion and the second frame portion, a bottom surface of the extension portion is lower than a bottom surface of the first supporting portion and a bottom surface of the second supporting portion.

* * * * *